US005594302A

United States Patent [19]

Yakub et al.

[11] Patent Number: 5,594,302

[45] Date of Patent: Jan. 14, 1997

[54] METAL HALIDE LAMP INCLUDING IRON AND MOLYBDENUM

[75] Inventors: Yuri Yakub; Yitzhak Azran, both of Ashkelon, Israel

[73] Assignee: Lamptech Ltd., Ashkelon, Israel

[21] Appl. No.: 517,866

[22] Filed: Aug. 22, 1995

[51] Int. Cl.[6] ..... H01J 61/20

[52] U.S. Cl. ..... 313/642; 313/571

[58] Field of Search ..... 313/571, 637, 313/638, 639, 642, 643; 445/26

[56] References Cited

U.S. PATENT DOCUMENTS

| | | | |
|---|---|---|---|
| 3,250,940 | 5/1966 | Koury et al. | 313/642 |
| 3,279,877 | 10/1966 | Smith et al. | 313/571 |
| 3,590,307 | 6/1971 | Dobrusskin | 313/642 |
| 4,155,025 | 5/1979 | Dobrusskun et al. | 313/229 |
| 4,929,869 | 5/1990 | Yonezawa et al. | 313/639 |
| 5,107,177 | 4/1992 | Barthelmes et al. | 313/623 |
| 5,107,178 | 4/1992 | Ohyama et al. | 313/639 |
| 5,184,044 | 2/1993 | Thomas | 313/638 |
| 5,220,244 | 6/1993 | Maseki et al. | 313/620 |
| 5,225,738 | 7/1993 | Ramaiah et al. | 313/641 |
| 5,239,232 | 8/1993 | Heider et al. | 313/639 |

FOREIGN PATENT DOCUMENTS

| | | | |
|---|---|---|---|
| 3912223A1 | 10/1990 | Germany | H01J 61/20 |
| 54-03973 | 3/1979 | Japan | H01J 61/20 |

*Primary Examiner*—Brian Zimmerman
*Assistant Examiner*—Michael Day
*Attorney, Agent, or Firm*—Mark M. Friedman

[57] ABSTRACT

A metal halide lamp for producing high-intensity ultraviolet radiation contains an inert gas and a filler. The filler includes iodine and/or bromine in an overall concentration of from about 0.030–1.110 mg/cm$^3$, mercury in a concentration of from about 0.318–5.250 mg/cm$^3$, iron in a concentration of from about 0.005–0.036 mg/cm$^3$, molybdenum in a concentration of from about 0.006–0.120 mg/cm$^3$, and optionally, cobalt in a concentration of from about 0.0045–0.036 mg/cm$^3$. The molybdenum is preferably introduced in the form of metal powder. The iodine and/or bromine is preferably introduced in the form of the corresponding mercury halides.

13 Claims, 3 Drawing Sheets

METAL HALIDE LAMP INCLUDING IRON AND MOLYBDENUM

FIELD AND BACKGROUND OF THE INVENTION

The present invention relates to ultraviolet lamps and, in particular, to metal halide lamps for producing high-intensity ultraviolet radiation.

It is known to use a metal halide lamp for producing ultraviolet radiation. U.S. Pat. No. 4,155,025 to Dobrusskin et al. discloses a high-pressure mercury-vapor discharge lamp having a filler including a halide together with a combination of at least two metals selected from iron, nickel and cobalt.

Japanese Patent No. 4929.869 discloses a lamp with a filler containing a halide together with mercury, iron and silver.

A-type ultraviolet radiation is typically defined as the region of the electromagnetic radiation spectrum with wavelengths between 315 and 400 nm. Wavelengths of major technological importance are generally in the range from 340 to 400 nm, and especially from 350 to 370 nm. However, the radiant efficiency of conventional lamps in these ranges is unacceptably low. Typically, 13–16% of the lamp's power is emitted as radiation of wavelengths between 340 and 400 nm, and 6–7% between 350 and 370 nm.

There is therefore a need for high-intensity ultraviolet lamps with improved radiant efficiency in the range of wavelengths from 340 to 400 nm, and especially from 350 to 370 nm.

SUMMARY OF THE INVENTION

The present invention is of metal halide lamps for producing high-intensity ultraviolet radiation.

According to the teachings of the present invention there is provided, a metal halide lamp having a working volume, the lamp for producing high-intensity ultraviolet radiation, the lamp comprising an inert gas and a filler, the filler including: (a) a halide component selected from iodine, bromine and a combination of iodine and bromine, the halide component being present in a concentration of from about 0.030 to about 1.110 mg per cubic cm of the working volume; (b) mercury, present in a concentration of from about 0.318 to about 5.250 mg per cubic cm of the working volume; (c) iron, present in a concentration of from about 0.005 to about 0.036 mg per cubic cm of the working volume; and (d) molybdenum, present in a concentration of from about 0.006 to about 0.120 mg per cubic cm of the working volume.

According to a further feature of the present invention, the filler further includes cobalt, present in a concentration of from about 0.0045 to about 0.036 mg per cubic cm of the working volume.

According to a further feature of the present invention, the cobalt is present in a concentration of from about 0.012 to about 0.015 mg per cubic cm of the working volume.

According to a further feature of the present invention, the cobalt is present in a concentration of about 0.012 mg per cubic cm of the working volume.

According to a further feature of the present invention, the molybdenum is present in a concentration of from about 0.010 to about 0.030 mg per cubic cm of the working volume.

According to a further feature of the present invention, the molybdenum is present in a concentration of from about 0.018 to about 0.020 mg per cubic cm of the working volume.

According to a further feature of the present invention, the molybdenum is present in a concentration of about 0.018 mg per cubic cm of the working volume.

According to a further feature of the present invention, the halide component is iodine.

According to a further feature of the present invention, the halide component is present in a concentration of from about 0.10 to about 0.60 mg per cubic cm of the working volume.

According to a further feature of the present invention, the halide component is present in a concentration of about 0.36 mg per cubic cm of the working volume.

According to a further feature of the present invention, the mercury is present in a concentration of from about 1.41 to about 1.44 mg per cubic cm of the working volume.

According to a further feature of the present invention, the iron is present in a concentration of from about 0.024 to about 0.026 mg per cubic cm of the working volume.

According to a further feature of the present invention, the iron is present in a concentration of about 0.026 mg per cubic cm of the working volume.

According to the teachings of the present invention there is also provided a method of manufacturing a high-intensity ultraviolet metal halide lamp comprising the step of introducing a filler including molybdenum metal powder into the lamp.

According to a further feature of the present invention, the filler also includes a halogen component chosen from iodine, bromine, and a combination of iodine and bromine, the halogen component being introduced into the lamp in the form of at least one mercury halide.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of metal halide lamps for producing high-intensity ultraviolet radiation.

The principles and operation of lamps according to the present invention may be better understood with reference to the drawings and the accompanying description.

Figure 1:
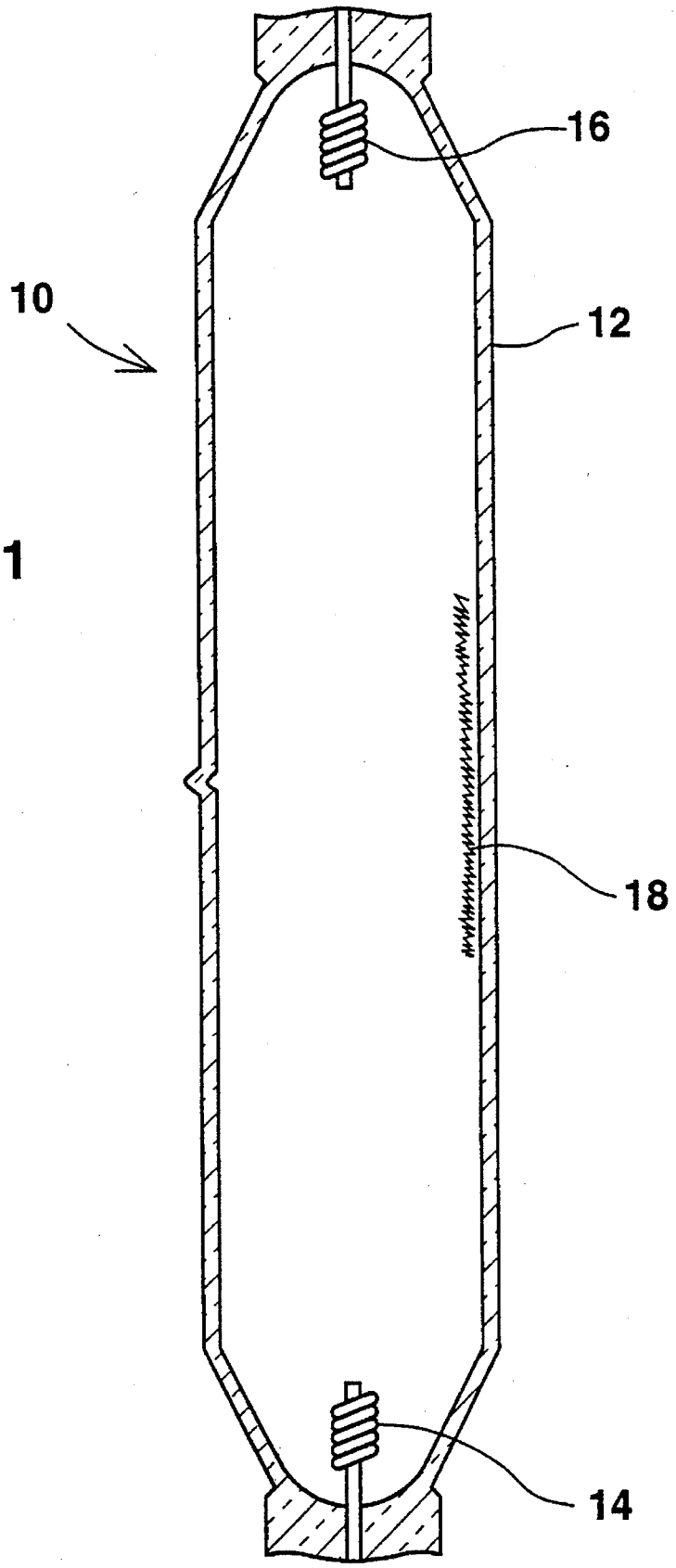
FIG. 1 is a schematic cross-sectional view through a lamp constructed and operative according to the teachings of the present invention.

Referring now to the drawings, FIG. 1 shows a lamp, generally designated 10, constructed and operative according to the teachings of the present invention. Generally speaking, lamp 10 is a gas-discharge lamp, having a bulb 12 and two electrodes 14, 16. Bulb 12 contains an inert gas, such as argon, and a filler 18. Filler 18 includes a halide component consisting of iodine or bromine or a combination of iodine and bromine, mercury, iron, and, preferably, cobalt. In addition, it is a particular feature of lamps of the present invention that filler 18 includes molybdenum.

Relating now to the features of lamp 10 in more detail, bulb 12 and electrodes 14, 16 may be similar to those used in conventional ultraviolet lamps. Bulb 12 is typically made from quartz glass, which is transparent to ultraviolet radiation and remains structurally and chemically stable under operational conditions up to 900° C. Alternatively, any other ultraviolet-transparent material with similar properties may be used. Typically, bulb 12 is approximately cylindrical, although other shapes may also be used.

Bulb 12 contains inert gas such as argon, as is known in the art. Typically, bulb 12 is filled with inert gas up to a pressure of about 2.5 kPa.

The geometry of bulb 12 is chosen so as to define the required power of lamp 10, as is known in the art. Typically, the power of lamp 10 is in the range from a few hundred watts up to several kilowatts, and is preferably about one kilowatt.

As will be explained below, the essence of the present invention relates to the combination of components present in filler 18, and their respective quantities. These components will now be addressed individually. Since the effects of each component of filler 18 depends on its concentration when dispersed within bulb 12 during operation of lamp 10, the quantity for each component will be given here in terms of a concentration. For this purpose, the internal volume of bulb 12 will be referred to both in the description and claims as the "working volume" lamp 10. Concentrations for each component will be stated in terms of mg of the component in filler 18 per cubic cm of the working volume.

Relating first to the mercury content of filler 18, this generally determines the operating current for a given geometry of lamp, as is known in the art. If the mercury concentration is below about 0.318 mg/cm$^3$, inadequate spreading of the mercury emission lines in the radiation spectrum reduces the radiant efficiency. Above about 5.25 mg/cm$^3$, the operating temperature of the lamp will be reduced, also resulting in reduced efficiency. Preferably, the mercury content of filler 18 is in the range 1.41–1.44 mg/cm$^3$. In the case of a 1 kW lamp, the highest efficiency is achieved when the current is about 7.8 amps. This corresponds to a mercury concentration of about 1.41 mg/cm$^3$.

Relating next to the iron content of filler 18, this must lie within the range between about 0.005 and about 0.036 mg/cm$^3$. Below this range, radiant efficiency is reduced due to an insufficient concentration of radiating atoms. Above this range, the operating temperature of lamp 10 will be reduced, also resulting in reduced efficiency. Preferably, the iron content of filler 18 is in the range 0.024–0.026 mg/cm$^3$, and most preferably about 0.026 mg/cm$^3$.

The use of cobalt in filler 18, while not essential to the present invention, increases the radiant efficiency of lamp 10 within the important 350–370 nm wavelength band by the addition of cobalt's spectral emission lines. When used, the cobalt content of filler 18 should lie within the range between about 0.0045 and about 0.036 mg/cm$^3$. Below this range, the cobalt will not make a significant contribution to the radiant efficiency of lamp 10. Above this range, the operating temperature of lamp 10 will be reduced, resulting in reduced radiant efficiency. Preferably, the cobalt content of filler 18 is in the range 0.012–0.015 mg/cm$^3$, and most preferably about 0.012 mg/cm$^3$.

It is a particular feature of the present invention that filler 18 contains molybdenum. The presence of molybdenum in filler 18 results in a distinct and surprising improvement in radiant efficiency of lamp 10 over the wavelength ranges of interest, as will be illustrated with reference to FIGS. 2 and 3 below. Without in any way limiting the scope of the present invention, it is believed that this improved radiant efficiency is due to two factors. Firstly, the addition of the spectral emission lines of molybdenum between 380 and 390 nm increases the radiant efficiency of lamp 10 in the 340–400 nm wavelength band of interest. Secondly, it has been discovered that the presence of molybdenum is surprisingly also effective to enhance the radiant efficiency within the particularly important 350–370 nm wavelength band. This effect is believed to be due to the formation of complex compounds, such as iron-molybdenum and cobalt-molybdenum halides, which are more volatile than the simple halides. This results in a higher concentration of radiating atoms being in a vapor phase during the operation of lamp 10, thereby increasing the radiant efficiency.

The molybdenum content of filler 18 should lie within the range between about 0.006 and about 0.120 mg/cm$^3$. Below this range, the molybdenum will not make a significant contribution to the radiant efficiency of lamp 10. Above this range, the molybdenum emission lines will tend to dominate the spectral emission of lamp 10, thereby reducing the radiant efficiency in the particularly important 350–370 nm wavelength band. Preferably, the molybdenum content is in the range 0.010–0.030 mg/cm$^3$. Optimally, in order to maximize the formation of iron-molybdenum and cobalt-molybdenum complexes of the form $FeMoH_4$ and $CoMoH_4$ where H represents iodine or bromine, the molar concentration of molybdenum, corresponding to the number of atoms per unit volume, should approach the sum of the molar concentrations of iron and cobalt present. However, when present in concentrations significantly greater than about 0.02 mg/cm$^3$, the radiant efficiency may be decreased by deposition of molybdenum on the walls of lamp 10. Most preferably, the molybdenum content of filler 18 is in the range 0.018–0.020 mg/cm$^3$. In the case of the most preferred concentrations of iron and cobalt given above, the corresponding optimal concentration of molybdenum is about 0.018 mg/cm$^3$.

Finally, relating to the halide component of filler 18, this must lie in the range between about 0.0310 and about 1.110 mg/cm$^3$. Below this range, there will be insufficient formation of metal halides, resulting in the condensation of the metal components other than mercury on the inner surface of bulb 12. Above this range, the iodine and/or bromine will become involved with the discharge interaction, reducing the efficiency of lamp 10. Preferably, the halide component of filler 18 constitutes between about 0.10 and about 0.60 mg/cm$^3$. Optimally, the total molar concentration of iodine and bromine atoms should be slightly larger than double the sum of the molar concentrations of the iron, cobalt and molybdenum atoms in filler 18. Some surplus is additionally valuable as it tends to collect near the inner surface of bulb 12 thereby protecting the quartz wall from chemical reaction during operation of lamp 10. Although iodine and bromine may be used interchangeably or in combination, best results are generally achieved using iodine alone. In the case of the most preferred concentrations of iron, cobalt and molybdenum given above, the corresponding optimal concentration of iodine is about 0.3626 mg/cm$^3$.

It should be noted that certain modifications must be made to conventional manufacturing methods in order to implement the present invention effectively. In particular, the metal components other than mercury of fillers used in the prior art are commonly introduced to a lamp as metal halides. This is the obvious choice for two reasons. Firstly, the halides are sufficiently volatile to vaporize at the operating temperatures of the lamp, thereby accelerating start-up of the lamp. Secondly, the metal halides are in fact the compounds which are active in the operational cycle of the lamp. Mercury, which vaporizes at low temperatures, is commonly introduced in elemental (liquid) form.

In the context of the present invention, however, use of metal halides in the preparation of lamp 10 proves to be problematic. Since molybdenum halides are highly hygroscopic and carbon dioxide-absorbent, use of molybdenum halides results in significant levels of water and carbon dioxide impurities, thereby reducing the efficiency of lamp 10.

To solve this problem, it has been discovered that the molybdenum content of filler 18, and possibly also the iron and cobalt content, is preferably provided in the form of elemental metal powder. The appropriate amounts of bromine and/or iodine are then provided in the form of mercury halide powders. The amount of elemental mercury liquid to be present in filler 18 is calculated as the total mercury content required less the amount of mercury added in the form of mercury halides.

In operation, lamp 10 passes through various stages of a warm-up process. When lamp 10 is activated by application of an appropriate voltage, typically about 220–240V A.C. at about 50–60 Hz, across electrodes 14 and 16, a discharge occurs through the inert gas within a region between electrodes 14 and 16. This discharge causes an increase in temperature within bulb 12 such that the mercury present in filler 18 evaporates, migrates to the discharge region and becomes involved in the discharge. As the temperature increases further, the mercury halide present in filler 18 evaporates and dissociates, releasing hot iodine and/or bromine which react with the metal powders in filler 18 to form metal halides. The mercury discharge raises the temperature at the wall of bulb 12 to between about 650° and about 800° C., and preferably to between about 700° and about 750° C. At these temperatures the metal halides evaporate and dissociate, with the result that each of the metals present in filler 18 reaches the discharge region where it interacts and gives off radiation.

Figure 2:
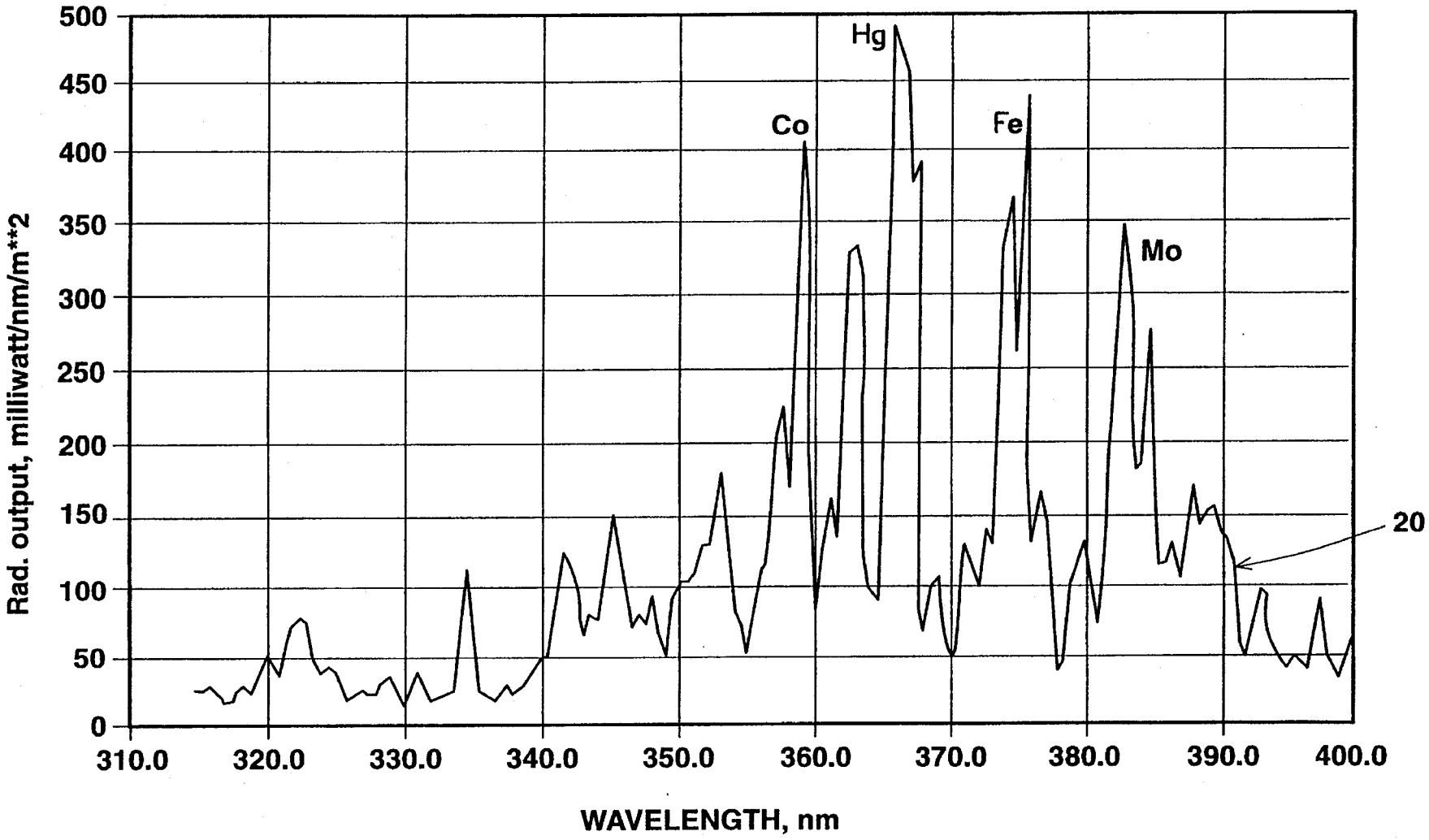
FIG. 2 is a graph showing a radiant-power emission spectrum of a lamp containing molybdenum, the lamp being constructed and operative according to the teachings of the present invention.
Figure 3:
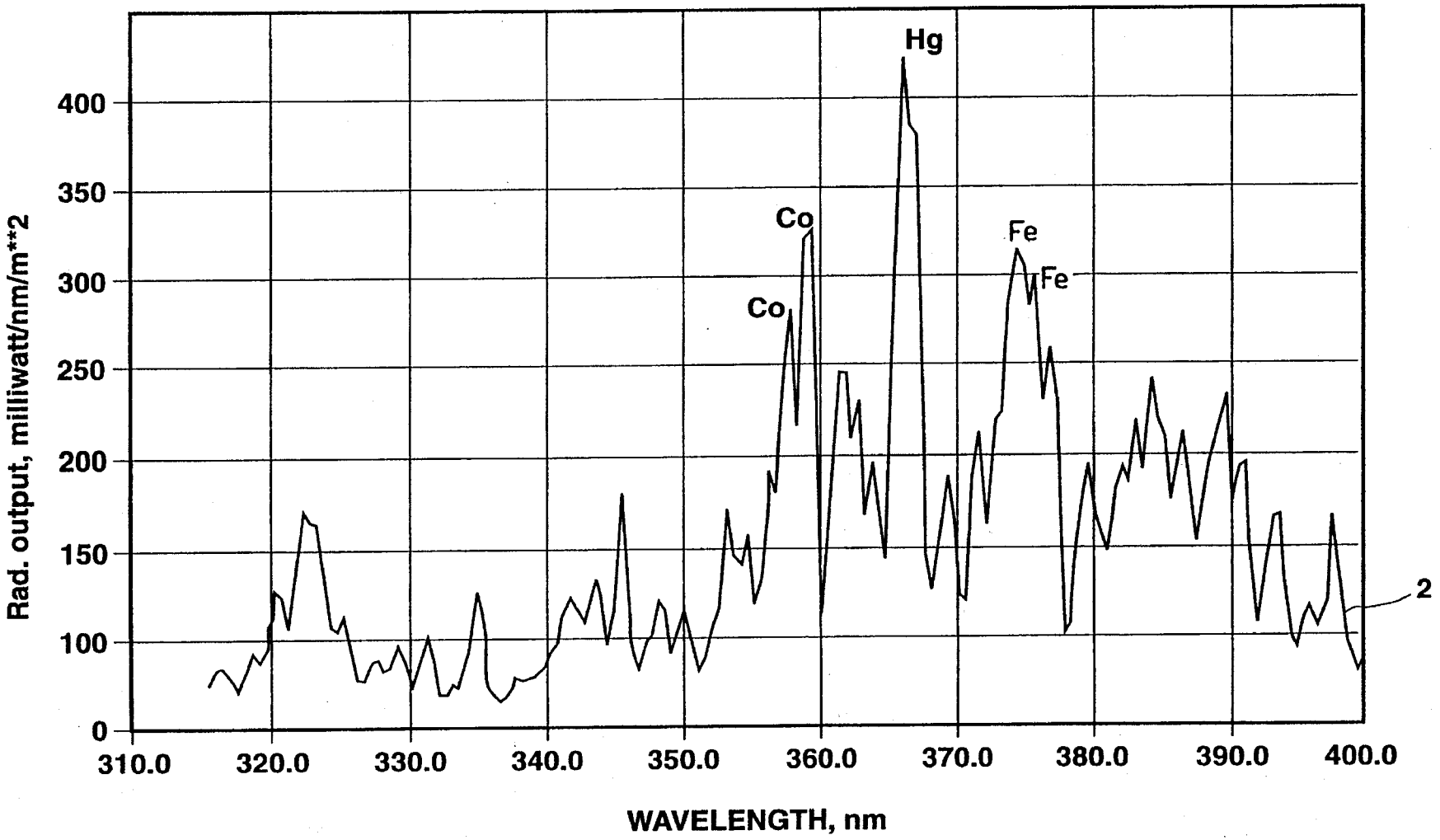
FIG. 3 (PRIOR ART)
FIG. 3 is a graph showing, for the purpose of comparison, a radiant-power emission spectrum of a lamp according to the prior art, not containing molybdenum.

Referring now to FIGS. 2 and 3, the significance of the use of molybdenum in the lamps of the present invention will be illustrated. FIG. 2 shows a plot, generally designated 20, corresponding to the ultraviolet power spectrum of lamp 10. FIG. 3 shows a plot, generally designated 22, corresponding to the ultraviolet power spectrum of lamp similar to lamp 10 but without the molybdenum component taught by the present invention. Both plots 20 and 22 correspond to lamps rated at 1000W, containing 1.4100 mg/cm$^3$ mercury, 0.3626 mg/cm$^3$ iodine, 0.0260 mg/cm$^3$ iron, and cobalt. The lamp of FIG. 2 additionally contains 0.0180 mg/cm$^3$ molybdenum.

A comparison between plot 20 and plot 22 reveals the effects of the presence of molybdenum in filler 18. As might be expected, plot 20 displays the characteristic molybdenum emissions at about 383–385 nm range not present in plot 22. In addition, plot 20 clearly shows increased radiated power at wavelengths associated with the other components of filler 18. This effect may be attributed to the formation of complexes, as described above.

A number of examples will now be given to illustrate the improved efficiency of lamps constructed according to the teachings of the present invention. Nine lamps, each with a different filler composition, were prepared and tested. Each lamp was prepared using an optically-transparent quartz glass bulb filled with argon to a pressure of 2.5 kPa. Each lamp was rated at 1000W and tested with a conventional choke coil at a supply voltage of 220V and a frequency of 50 Hz. For each lamp, measurements were made of radiant efficiency (R.E.) both in the wider 340–400 nm ("broad") wavelength range, and in the narrower 350–370 nm ("narrow") range. The filler compositions used and the corresponding results are summarized in Table 1:

TABLE 1

| Ex. | Hg (mg/cm$^3$) | I (mg/cm$^3$) | Br (mg/cm$^3$) | Fe (mg/cm$^3$) | Co (mg/cm$^3$) | Mo (mg/cm$^3$) | R.E. (broad) | R.E. (narrow) |
|---|---|---|---|---|---|---|---|---|
| 1 | 0.51300 | 0.10216 | NONE | 0.00500 | 0.00450 | 0.00600 | 22.0 | 9.0 |
| 2 | 0.51000 | NONE | 0.03100 | 0.00500 | 0.00450 | 0.00600 | 22.0 | 8.8 |
| 3 | 1.41000 | 0.36260 | NONE | 0.02600 | 0.01200 | 0.01800 | 26.0 | 11.0 |
| 4 | 1.43900 | 0.01927 | 0.26600 | 0.02700 | 0.01400 | 0.01601 | 24.0 | 9.9 |
| 5 | 5.24600 | 1.09525 | NONE | 0.03500 | 0.03500 | 0.12000 | 23.3 | 9.4 |
| 6 | 4.97000 | 0.14860 | 0.53200 | 0.03500 | 0.03500 | 0.12000 | 22.3 | 9.4 |
| 7 | 0.31800 | 0.59280 | 0.17700 | 0.02300 | 0.02300 | 0.02800 | 22.5 | 8.8 |
| 8 | 4.87000 | 0.02200 | 0.01200 | 0.03550 | 0.03550 | 0.12000 | 22.8 | 9.3 |
| 9 | 1.43500 | 0.09970 | 1.01000 | 0.03500 | 0.03500 | 0.12000 | 22.1 | 9.3 |

These examples indicate the superior performance of lamps prepared with a wide range of filler compositions according to the teachings of the present invention. Each of these compositions provides a radiant efficiency improved by 5–10% in the 340–400 nm "broad" range and by 3–5% in the 350–370 nm "narrow" range compared to the prior art. In particular, the composition of filler 18 in Example 3 provides exceptionally high efficiency in both ranges of interest. This composition may be considered an approximate indication of the optimal concentration for each of the components of filler 18.

It will be appreciated that the above descriptions are intended only to serve as examples, and that many other embodiments are possible within the spirit and the scope of the present invention.

What is claimed is:

1. A metal halide lamp having a working volume, the lamp for producing high-intensity ultraviolet radiation, the lamp comprising an inert gas and a filler, said filler including:

(a) a halide component selected from iodine, bromine and a combination of iodine and bromine, said halide component being present in a concentration of from about 0.030 to about 1.110 mg per cubic cm of the working volume;

(b) mercury, present in a concentration of from about 0.318 to about 5.250 mg per cubic cm of the working volume;

(c) iron, present in a concentration of from about 0.005 to about 0.036 mg per cubic cm of the working volume; and (d) molybdenum, present in a concentration of from about 0.006 to about 0.120 mg per cubic cm of the working volume.

2. The metal halide lamp of claim 1, wherein said filler further includes cobalt, present in a concentration of from about 0.0045 to about 0.036 mg per cubic cm of the working volume.

3. The metal halide lamp of claim 2, wherein said cobalt is present in a concentration of from about 0.012 to about 0.015 mg per cubic cm of the working volume.

4. The metal halide lamp of claim 2, wherein said cobalt is present in a concentration of about 0.012 mg per cubic cm of the working volume.

5. The metal halide lamp of claim 1, wherein said molybdenum is present in a concentration of from about 0.010 to about 0.030 mg per cubic cm of the working volume.

6. The metal halide lamp of claim 1, wherein said molybdenum is present in a concentration of from about 0.018 to about 0.020 mg per cubic cm of the working volume.

7. The metal halide lamp of claim 1, wherein said molybdenum is present in a concentration of about 0.018 mg per cubic cm of the working volume.

8. The metal halide lamp of claim 1, wherein said halide component is iodine.

9. The metal halide lamp of claim 1, wherein said halide component is present in a concentration of from about 0.10 to about 0.60 mg per cubic cm of the working volume.

10. The metal halide lamp of claim 1, wherein said halide component is present in a concentration of about 0.36 mg per cubic cm of the working volume.

11. The metal halide lamp of claim 1, wherein said mercury is present in a concentration of from about 1.41 to about 1.44 mg per cubic cm of the working volume.

12. The metal halide lamp of claim 1, wherein said iron is present in a concentration of from about 0.024 to about 0.026 mg per cubic cm of the working volume.

13. The metal halide lamp of claim 1, wherein said iron is present in a concentration of about 0.026 mg per cubic cm of the working volume.

* * * * *